United States Patent [19]

Brodman et al.

[11] 4,315,785

[45] Feb. 16, 1982

[54] PROPELLANT CHARGE WITH REDUCED MUZZLE SMOKE AND FLASH CHARACTERISTICS

[75] Inventors: Bruce W. Brodman, Stroudsburg, Pa.; Michael P. Devine, Sparta, N.J.; Stuart Schwartz, Indianapolis, Ind.

[73] Assignee: The United States of America as represented by the Secretary of the Army, Washington, D.C.

[21] Appl. No.: 138,946

[22] Filed: Apr. 9, 1980

[51] Int. Cl.[3] ..... C06B 45/10; C06B 45/00

[52] U.S. Cl. ..... 149/19.8; 102/289; 102/704; 149/2; 149/100; 149/115

[58] Field of Search ..... 102/290, 700, 704, 289; 149/2, 19.8, 100, 115

[56] References Cited

U.S. PATENT DOCUMENTS

| | | | |
|---|---|---|---|
| 3,527,168 | 9/1970 | McMurdy | 149/2 |
| 3,713,915 | 1/1973 | Fast | 149/2 |
| 3,714,047 | 1/1973 | Marion | 102/704 |
| 3,749,615 | 7/1973 | Dorsey et al. | 102/289 |
| 3,877,374 | 4/1975 | Cook | 102/700 |
| 3,909,322 | 9/1975 | Chang et al. | 149/19.4 |
| 4,001,126 | 1/1977 | Marion et al. | 102/290 |
| 4,029,529 | 6/1977 | Elrick et al. | 149/19.8 |
| 4,038,115 | 7/1977 | Dehm | 149/19.8 |
| 4,216,039 | 8/1980 | Pierce | 149/19.8 |

OTHER PUBLICATIONS

Meyer, "Explosives", p. 185, Verlag Chemie, Weinheim (1977) New York.

*Primary Examiner*—Edward A. Miller

*Attorney, Agent, or Firm*—Nathan Edelberg; Robert P. Gibson; A. Victor Erkkila

[57] ABSTRACT

A method and improved propellant composition for eliminating secondary muzzle flash in small and large caliber weapons without the increased smoke production or inhibiting burning characteristics through the step of incorporating a novel microencapsulated organic coolant additive into a conventional propellant composition wherein the microencapsulated coolant will survive the propellant flame zone intact so as to decompose down barrel to cool the bases exiting the weapon barrel. The preferred organic coolant is oxamide microencapsulated within a gelatin wall material and coated with Bakelite TM.

12 Claims, No Drawings

PROPELLANT CHARGE WITH REDUCED MUZZLE SMOKE AND FLASH CHARACTERISTICS

DEDICATORY CLAUSE

The invention described herein may be manufactured, licensed, and used by or for the Government for governmental purposes without the payment to us of any royalty thereon.

BACKGROUND OF THE INVENTION

The invention relates to a novel method and propellant composition for use in small and large caliber weapon ammunition to eliminate secondary muzzle flash without increasing production of smoke through incorporation of a microencapsulated coolant within a conventional double base extruded and ball propellants.

The invention further relates to an ammunition propellant composition and method whereby a coolant is added without reducing overall performance of the ammunition while reducing secondary muzzle flash without increasing smoke production.

The problems of smoke and muzzle flash have existed since the time small arm weapons have come into use. In most instances, the problems have been traced to one or more characteristics of the ammunition's propellant. In particular, muzzle flash may be divided into two phases, primary and secondary. Primary muzzle flash is due mainly to radiation of high energy gases as they leave the muzzle and produce a glow of short duration adjacent to the muzzle. Secondary flash is caused by oxidation of the combustible muzzle gases and is more objectionable since it produces a large flash of relatively long duration, beginning a short distance from the muzzle. This muzzle flash creates a problem of position disclosure, particularly at night, while muzzle smoke is objectionable because of daytime position disclosure.

Two methods are currently used to reduce secondary muzzle flash, namely the use of mechanical flash hiders on small arms weapons or the addition of chemical flash suppressants to standard ammunition propellant compositions. The use of mechanical flash hiders has not been satisfactory because they contribute to the weight of the weapon. Chemical flash suppressants used in small arms propellants consist of about one percent of potassium salts, i.e., sulfate or potassium nitrate as terminators for oxidative chain reactions, but are undesirable because they are the greatest single contribution to muzzle smoke.

Though muzzle smoke production is a function of many parameters, e.g., the oxygen balance of the propellants, ingredients, flame temperature, primer compositions and the like, the greatest single contributor is potassium. Thus prior art flash suppressants have only exacerbated the problem of position disclosure, as well as obscuring the gunner's vision.

The novel propellant composition of this invention containing a microencapsulated oxamide coolant has succeeded in passing through the flame zone intact, and has functioned in the gun barrel to cool the exiting gases so as to prevent muzzle flash without increased smoke production or interference with propellant burning behavior.

Moreover, the microencapsulated oxamide coolant of this invention has succeeded in providing a generic solution to the problem of muzzle flash for the new more energetic nitramine propellants, e.g., the cyclic nitramine propellant cyclo trimethylene trinitramine (RDX) and cyclo tetramethylene tetranitramine (HMX), which are characterized by a lower flame and a higher volumetric impulse than conventional nitroglycerine-nitrocellulose-triacetin ammunition propellants.

SUMMARY OF THE INVENTION

A method of eliminating secondary muzzle flash in small and large caliber weapons through use of a novel ammunition propellant composition comprising a conventional double base extruded propellant as well as more energetic nitramine composition and a microencapsulated oxamide coolant additive for cooling the gases exiting the weapons barrel. In the preferred embodiment, the oxamide is encapsulated with a gelatin and the resulting microcapsules are coated with a plastic resin, e.g., Bakelite TM.

It is the principal object of the invention to provide a novel gun propellant which will eliminate secondary muzzle flash while avoiding smoke production and interference with the burning characteristics of the gun propellant.

It is another object of this invention to provide a novel microencapsulated propellant additive which will pass through the propellant flame zone intact and decompose during its passage through the barrel to cool the exiting gases so as to eliminate muzzle flash.

A further object of this invention is to provide a method for eliminating muzzle flash without interfering with the propellant burning behavior or increasing smoke production.

A still further object of this invention is to provide a method for eliminating the risk of gunner's position disclosure through reduction of secondary muzzle flash and smoke production in small and larger caliber weapon systems.

These and other objects of this invention will become apparent from the following description of the invention.

DESCRIPTION OF THE INVENTION

The incorporation of relatively large amounts of microencapsulated oxamide coolant additive to a conventional ammunition propellant composition has successfully eliminated secondary muzzle flash, avoiding the need for potassium salts flash suppressants, which are the greatest source of muzzle smoke. The microencapsulated oxamide had achieved this suppression of muzzle flash without interfering with the burning behavior of the propellant through the mechanism of providing a wall material which will be expelled from the burning propellant matrix and survive the propellant flame zone intact to subsequently release the coolant down barrel where it can act upon the exiting propellant gases to eliminate muzzle flash.

The wall material used for microencapsulation of the oxamide coolant additive must be capable of surviving the flame zone and yet decompose at a later time, i.e., down barrel to liberate oxamide so that it can cool the exiting gases. Capsules having various wall materials were embedded in a transparent acrylic plastisol propellant matrix and combustion tests were performed by ignition in a windowed bomb (Atlantic Research Corp.) at 800 psi nitrogen in which high speed photographs were taken. These combustion tests revealed that gelatin was best suited for use as a wall material in a propellant composition and that better thermal stability could be achieved by encapsulating the oxamide coolant in gelatin and coating the wall with Bakelite TM (a synthetic polymer resin obtained by condensation of formaldehyde with phenols). An ethocel wall material could also be used, but the resulting microcapsule has less thermal stability than that of gelatin microcapsules.

Various encapsulation procedures may be used to prepare the oxamide microencapsulated coolant of this invention, with the coacervation method for encapsulation developed by National Cash Register Co. (Kirk-Othmer, Encyclopedia of Chemical Technology, Vol. 13, pp 436–456, NY, NY, John Wiley and Sons, Inc.; 1967) being preferred due to its wide applicablilty to particle size, material encapsulated, and wall materials. The coacervation method is basically a three-step process involving:

(1) dispersion of the oxamide in a gelatin solution and the subsequent phasing out of solution of the gelatin by system shange, e.g., temperature, concentration of solvent addition;

(2) adsorption of the gelatin on the oxamide nucleus in order to form the wall by means of achieving a net decrease in free interfacial energy of the system and, (3) solidification and isolation of the capsules by means of further reduction in temperature, further addition of nonsolvent, change in pH or through chemical reactions involving cross-linking chelation, and grafting. Solidified capsules are then isolated by filtration and dried.

The effect of encapsulation of the oxamide coolant in a gelatin-Bakelite TM wall on the burning rate of a double base propellant composition (calculated from $\dot{p}$ vs p curves) was tested with the following propellant composition:

| | Nominal Composition (%) |
|---|---|
| Nitrocellulose | 46.0 |
| 2-Nitrodiphenylamine | 1.0 |
| Di-n-propyl adipate | 7.7 |
| Nitroglycerine | 35.0 |
| Candelilla Wax | 0.3 |
| Oxamide | 10.0 |

wherein the first mix contained unencapsulated oxamide and the second mix contained the encapsulated oxamide of this invention. The capsules of oxamide incorporated in mix #2 ranged from 63 to 74 microns maximum dimension and the phase ratio was 1 to 4 (wall material to nucleus).

The mixes were extruded as 1.27 cm diameter cylinders. Both compositions extruded well, the only difference being that mix #1 (unencapsulated) was extruded at a pressure of 1.72 meganewtons/m$^2$ (250 psi) while the second mix (encapsulated) was extruded at a pressure of 2.07 meganewtons/m$^2$ (300 psi). The extrudate from both mixes was smooth and well consolidated. The closed bomb linear burning rate data are shown in the table below.

| Burning Rate | | | | | | | |
|---|---|---|---|---|---|---|---|
| | | Mix #1 | | Mix #2 | | Difference in burning rate between mixes #1 and #2 | |
| Pressure | | cm/ | (in./ | cm/ | (in./ | cm/ | (in./ |
| MN/m$^2$ | (psi) | sec | sec) | sec | sec) | sec | sec) |
| 33.10 | (4,800) | 1.80 | (0.71) | 2.36 | (0.93) | 0.56 | (0.22) |
| 62.74 | (9,100) | 3.96 | (1.56) | 4.62 | (1.82) | 0.66 | (.26) |
| 92.39 | (13,400) | 6.17 | (2.43) | 6.81 | (2.68) | 0.64 | (.25) |
| 122.04 | (17,700) | 8.31 | (3.27) | 9.07 | (3.57) | 0.76 | (.30) |

The linear burning rates reported above are the average of three determinations. The mix containing gelatin-Bakelite TM encapsulated oxamide consistently had a higher linear burning rate. Determination of linear burning rate constants from the above results using the relationship $r=bp^n$, wherein a value of pressure p in psi yields a burning rate in in./sec., revealed that the encapsulated oxamide has a higher linear burning rate and lower pressure exponent. Prior art attempts at incorporation of simlarly large amounts of additives, such as coolants and flash suppressants, in propellant compositions resulted in increased pressure exponents and lower linear burning rates. Thus encapsulation of the oxamide protects it from decompositon in the propellant flame zone.

The preferred ammunition configuration of this invention consists of a standard 7.62 mm case, projectile, and primer, containing a double base extruded propellant which in turn has homogeneously incorporated therein, oxamide microencapsulated within a gelatin walled capsule coated with Bakelite. Actual weapon firings of this novel propellant composition confirmed that the wall materials possessed requisite thermal stability to survive the propellant flame zone intact, yet decompose down barrel before muzzle exit. Thus, the oxamide acts to cool the exiting gases and thereby eliminate secondary muzzle flash without increased smoke and inhibition of propellant burning behavior.

Ballistic firings were performed in accordance with the standard 7.62 mm specification testing procedures. Velocity was measured by means of a lumiline screen and pressures were measured by means of copper pressure gauges. The weapon utilized a universal action with either a pressure or a velocity barrel. An RCA 6199 photomultiplier tube, used in conjunction with a photopic filter (International Light WB 640), was positioned above and in front of the weapon. A dual-beam oscilloscope (Tektronix type 565) with dual trace amplifier was used to send the photomultiplier output to a Bell and Howell Data Tape unit (UR-3700B) and time marks were sent directly to the tape unit. Photomultiplier tube voltage and time data were obtained by playing both the time marks and output voltage through the oscilloscope, where it was photographically recorded. Prior to firing, the photometer system was calibrated through use of a G.E. No. 67 lamp having 2.82 candela (cd) intensity (0.156 volts output). The illumination (E) in lu/ft$^2$ of the muzzle flash was calculated according to the formula: $E=I/D^2$ wherein I is muzzle flash intensity in cd and D is distance from weapon to the phototube surface (held constant at 7 feet).

The weapon used for the photometer measurements was a 7.62 mm M14 rifle without a mechanical flash suppressor. Photometric data points were obtained by firing a 20 round burst in the automatic mode.

Closed bomb data was obtained utilizing a 191 cc vessel with propellant loading density of 0.2 gm/cc. Propellant ignition was accomplished by means of a Hercules M100 match with 0.5 grams black powder and data was recorded with a 607B Kistler transducer along with a computer data acquisition system. Examples: The ballistics data obtained using the above test system with encapsulated and unencapsulated propellant lots, along with compositions, are shown in the following table (velocities are the average of five measurements and pressures are the average of at least ten measurements):

TABLE I

| Propellant Lot and Charge Weight | Nitro-glycerin % | Specific gravity (b/cc) | Oxamide % | % Ethyl-Centra-lite | DPA % | Velocity ft/sec | Pressure Copper psi |
|---|---|---|---|---|---|---|---|
| 1. Propellant with encapsulated oxamide (44.27 grains) | 14.75 | 1.59 | 2.4 | 4.0 | 0.75 | 2468 | 33,700 |
| 2. Propellant with unencapsulated oxamide (44.27 grains) | 15.57 | 1.62 | 1.8 | 4.0 | 0.75 | 1692 | Too low to measure |
| 3a. Propellant without oxamide (39.2 grains) | 17.73 | 1.63 | 0.0 | 4.0 | 0.75 | 2440 | 27,400 |
| 3b. Propellant without oxamide (44.27 grains) | 17.73 | 1.63 | 0.0 | 4.0 | 0.75 | 2769 | 39,100 |

wherein the velocities were corrected to a reference velocity of 2736 ft/sec, pressure was corrected to a reference pressure of 43,900 psi.

The lot containing unencapsulated oxamide (Lot #2) gave very poor ballistics. The average velocity of the encapsulated lot was 2468 ft/sec and the specification velocity for 7.62 mm is 2750±15 ft/sec (maximum allowable average pressure of 48,000 psi). Although the velocities are low, minor compositional changes can be used to achieve the specification velocity.

Table II, below, shows the average results obtained from photometric measurements for the reference ammunition (Lot #4-FA-Y 7.62 mm-498), the lot containing encapsulated oxamide (Lot #1) and a lot similar to Lot #1, but containing no oxamide fired at both equivalent charge weight (Lot #3b) and velocity (Lot #3a).

TABLE II

| | PHOTOMETRIC DATA | | | | | | |
|---|---|---|---|---|---|---|---|
| LOT NO. | $V_1$ (volts) | $E_1$ (1u/ft$^2$) | $I_1$ (cd) | $V_2$ (Volts) | $E_2$ (1u/ft$^2$) | $I_2$ (cd) | To-o (msec) |
| 1 (44.27 grains) | 0.05 | 0.02 | 0.98 | — | — | — | 0.6 |
| 3a (39.2 grains) | 0.49 | 0.18 | 8.82 | 0.33 | 0.12 | 5.88 | 10.8 |
| 3b (44.27 grains) | 0.59 | 0.22 | 10.78 | 0.32 | 0.12 | 5.88 | 13.0 |
| 4 FA-Y Reference | 0.56 | 0.21 | 10.29 | 0.29 | 0.11 | 5.39 | 15.3 |

wherein To-o is the time duration from initial rise of the first peak to zero intensity at the end of the second peak of light intensity from muzzle flash.

It can be readily seen from examination of the intensity (I) and time duration (To-o) data that both the reference ammunition (Lot #4) and propellant lots #3a and 3b (for equivalent velocity and charge, respectively) exhibited greater intensity and considerably greater duration of flash while the encapsulated oxamide containing lot showed very low intensity and short duration with the absence of a secondary peak, i.e., no secondary muzzle flash. This indicates that the capsules not only survived the flame zone intact, but also decomposed down barrel, liberating the oxamide, which in turn cooled the muzzle gases before exit to diminish flash.

Closed bomb data was also obtained for the propellant lot without oxamide lot #3, unencapsulated oxamide propellant lot #2, and the encapsulated oxamide lot #1. The data was evaluated using dp/dt of lot #3 as the standard for determining relative quickness (RQ) at each given pressure. Note the reference propellant lot #3 has the highest RQ since it contains approximately 3% more nitroglycerine than the encapsulated lot #1. The results of the closed bomb tests and the computed relative quickness of the encapsulated and unencapsulated oxamide propellants composition are given, respectively, in Tables III and IV, below.

TABLE III

| | dp/dt (psi/sec.) | | |
|---|---|---|---|
| Pressure (psi) | Lot #1 (oxamide encapsulated) | Lot #2 (unencapsulated oxamide) | Lot #3 (no oxamide) |
| 4,000 | $4.5 \times 10^6$ | $2.4 \times 10^6$ | $4.7 \times 10^6$ |
| 8,000 | $9.9 \times 10^6$ | $5.0 \times 10^6$ | $11.3 \times 10^6$ |
| 12,000 | $14.8 \times 10^6$ | $8.5 \times 10^6$ | $17.9 \times 10^6$ |

TABLE IV

Relative Quickness Compared to Reference Propellant Lot #3 (w/o oxamide)

| | Computed RQ | | |
|---|---|---|---|
| Pressure (psi) | Lot #1 (encapsulated oxamide) | Lot #2 (unencapsulated oxamide) | Lot #3 (reference lot) |
| 4,000 | 0.96 | 0.51 | 1.0 |
| 8,000 | 0.88 | 0.44 | 1.0 |
| 12,000 | 0.83 | 0.47 | 1.0 |
| Average RQ | 0.88 | 0.47 | 1.0 |

A comparison of the average RQ for the unencapsulated and encapsulated lots reveals that the encapsulated lot is by far the faster and exhibits only minor interference with the propellant burning behavior of the reference propellant lot.

The foregoing ballistic tests of the novel propellant composition of this invention demonstrate its feasibility in weapons for elimination of secondary muzzle flash without interfering with propellant burning behavior. The propellant of this invention has also been shown to avoid the need for the alkali metal salt flash suppressors used in conventional ammunition and thus leads to a significant reduction in muzzle smoke.

Though the microencapsulated oxamide coolant of this invention can be used in any conventional small and large caliber weapon propellant for eliminating secondary muzzle flash, its use with the highly energetic nitramine propellants is particularly essential for eliminating secondary muzzle flash without contributing to smoke production due to the higher volumetric impulse and lower flame of these cyclic nitramines. The use of the oxamide coolant with nitramine propellants composition is therefore preferred.

The composition of the propellant used in this invention may be varied within the skill of one in the art to achieve desired ballistic characteristics. Similarly, the amount of organic coolant used in the propellant composition of this invention may be varied to obtain optimum reduction of secondary muzzle flash, though ordinarily, a propellant containing no more than 10 percent encapsulated organic coolant has been found to be sufficient for eliminating muzzle flash in large and small arms weapon ammunition.

Other organic coolants such as calcium oxalate, calcium oxide, tricesyl phosphate and calcium stearate could also be used as the encapsulated organic coolants of this invention, but these additives have been found to change the burning characteristics of the propellant, to some degree, and thus do not give optimum propellant ballistic performance.

The gelatin-Bakelite, wall material coating for the encapsulated organic coolant of this invention is preferred due to its thermal characteristic which allow the encapsulated coolant to survive the propellant flame zone intact yet decompose down barrel to release the coolant when it can perform its intended function of cooling exiting gases. The selection of wall material is thus critical to the extent that the capsule must survive the flame zone and decompose down barrel. Though gelatin-Bakelite has been found to possess these necessary properties, and is thus preferred, other wall materials which possess similar thermal resistance could, of course, be used to allow the organic coolant to pass through the flame zone intact and could be varied by one skilled in the art to use other wall materials, such as ethocel and other resin coatings, provided the resulting microcapsule possesses essentially the same thermal characteristic.

The particular details of the fabrication of the small arms ammunition from the novel propellant composition of this invention are not critical and can be selected from conventional shell casings, projectiles, primers and the like. Similarly, the propellant composition used in this invention is a conventional double base extruded propellant into which is homogeneously incorporated the unique microencapsulated organic coolant additive of this invention.

It is the essential feature of this invention that secondary muzzle flash is eliminated in small and large caliber weapons without increased smoke production through the incorporation of a novel microencapsulated oxamide organic coolant in the ammunition propellant and that the microcapsule is designed to survive the propellant flame zone intact so as to decompose down barrel where it will act to cool the exiting gases which would otherwise cause secondary muzzle flash.

Applicants having disclosed their invention, obvious modifications will become apparent to those skilled in the related munitions art. Applicants therefore desire to be limited only by the scope of the appended claims.

We claim:

1. A weapon propellant composition comprising a double based extruded propellant having homogeneously incorporated therein a microencapsulated organic coolant additive having thermal characteristics such that the microencapsulated coolant will survive the propellant flame zone intact and decompose down barrel to cool gases exiting the barrel and thus eliminate secondary muzzle flash while not adversely affecting propellant burning rates.

2. The composition of claim 1 wherein the propellant is a nitramine propellant.

3. The propellant composition of claim 2 wherein the microencapsulated organic coolant is oxamide.

4. The propellant composition of claim 2 wherein the oxamide is encapsulated within a gelatin wall material which is coated with a synthetic resin.

5. The propellant of claim 3 wherein the synthetic resin is a condensation reaction product of formaldehyde with phenols.

6. The propellant of claim 3 wherein the oxamide coolant is present in a concentration of up to 10% by weight of the propellant.

7. A method of eliminating secondary muzzle flash in small and large caliber weapon ammunition without increased production of muzzle smoke comprising the step of using a double based propellant having homogeneously incorporated therein a microencapsulated organic coolant additive which will survive the propellant flame zone intact and decompose down barrel to cool gases exiting the barrel and thus eliminate secondary muzzle flash.

8. The method of claim 7 wherein the propellant is a nitramine propellant.

9. The method of claim 8 wherein the coolant is a microencapsulated oxamide.

10. The method of claim 9 wherein the oxamide is encapsulated within a gelatin wall material which is coated with a synthetic resin.

11. The method of claim 10 wherein the resin is a condensation reaction polymer product of formaldehyde and phenols.

12. The method of claim 9 wherein the oxamide is present in a concentration of up to 10% by weight of the propellant.

* * * * *